US005938541A

United States Patent [19]

Allen et al.

[11] Patent Number: 5,938,541

[45] **Date of Patent: *Aug. 17, 1999**

[54] GOLF CLUB HEAD WITH SHORTENED HOSEL AND FERRULE

[75] Inventors: Dillis V. Allen, Elgin; Scott R. Longueil, Schaumburg, both of Ill.

[73] Assignee: Vardon Golf Company, Inc., Elk Grove Village, Ill.

[ * ] Notice: This patent is subject to a terminal disclaimer.

[21] Appl. No.: 08/960,966

[22] Filed: Oct. 30, 1997

Related U.S. Application Data

[63] Continuation-in-part of application No. 08/925,301, Sep. 8, 1997, Pat. No. 5,888,149.

[51] Int. Cl.[6] ..... A63B 53/02

[52] U.S. Cl. ..... 473/305; 473/310; 473/345; 473/306

[58] Field of Search ..... 473/305, 306, 473/307, 308, 309, 310, 311, 312, 313, 314, 315, 324, 345, 346

[56] References Cited

U.S. PATENT DOCUMENTS

| | | | |
|---|---|---|---|
| 1,480,056 | 1/1924 | Flint | 473/309 |
| 3,170,691 | 2/1965 | Pritchard | 473/309 |
| 5,273,280 | 12/1993 | Lo | 473/308 |
| 5,538,246 | 7/1996 | Dekura | 473/305 |
| 5,611,740 | 3/1997 | Nagamoto | 473/305 |
| 5,624,330 | 4/1997 | Tsuchida | 473/310 |

*Primary Examiner*—Sebastiano Passaniti
*Attorney, Agent, or Firm*—Dillis V. Allen, Esq.

[57] ABSTRACT

A golf club head with a shortened hosel and extended ferrule including a hollow body having a ball striking wall, and a top wall extending rearwardly from the ball striking wall. The hosel extends downwardly from the top wall with a shaft receiving bore therein, and extends upwardly from the top surface of the club a much shorter distance than conventional with a flat top surface much larger than normal and an annular outer surface that flares sharply outwardly. The ferrule head in some embodiments has a larger than normal lower surface equal in size and shape to the hosel top surface with an outer surface that curves sharply outwardly and downwardly in lower portions thereof in a smooth transition into the hosel outer surface. The top of the hosel bore is chamfered, and the ferrule is epoxied not only to the inserted shaft but also to the enlarged hosel top surface to increase the hosel's ability to absorb side loading from the inserted shaft. In several embodiments, the lower surface of the ferrule has an annular flange that seats in a counter bore in the club head.

7 Claims, 5 Drawing Sheets

GOLF CLUB HEAD WITH SHORTENED HOSEL AND FERRULE

RELATED APPLICATION

This application is a continuation-in-part of U.S. application Ser. No. 08/925,301, Filed: Sep. 8, 1997, entitled "GOLF CLUB HEAD WITH SHORTENED HOSEL AND FERRULE" now U.S. Pat. No. 5,888,149.

BACKGROUND OF THE PRESENT INVENTION

Hosel designs have changed markedly in the last five years of golf club technology. Callaway Golf innovated the reduced projecting hosel in its Big Bertha®[1] woods club line, and also it innovated other techniques to reduce the weight of the hosel.

1. Big Bertha is a registered trademark of Callaway Golf.

In my U.S. patent application Ser. No. 08/859,282, Filed: May 19, 1997, entitled OVERSIZE METAL WOOD WITH POWER SHAFT, I describe a hosel that includes a short hosel segment projecting downwardly from the top wall and a spaced also short hosel segment near the sole plate designed to reduce hosel weight without the sacrifice of strength.

Because metal drivers cannot exceed the weight range of 198 to 204 grams, every gram of saved weight is critical and, if saved, makes the design and manufacturing tasks far simpler. This is particularly true with stainless steel wood club heads because the trend to larger club heads in the last five years has made it difficult to utilize stainless steel and at the same time enlarge the head. This trend has been aided by the development of titanium alloy heads because these alloys with about 90% pure titanium have only 60% of the weight of stainless steels.

But what has happened is the public demand for heads in excess of 250 $cm.^3$ in volume has created almost the same weight problem in titanium that previously existed in the stainless steel head designs. Therefore, any weight saving technique, such as the one the present invention is directed, is now critical and important in the design and manufacture of titanium alloy heads, almost as much as it was in the smaller stainless steel heads.

Thus, the present invention is directed to devising an improved hosel design of substantially reduced weight without sacrificing the structural integrity of the head or of the received shaft, bearing in mind that today's shafts are primarily graphite compositions and prone to fracture in the area just above the hosel.

Most graphite shaft manufacturers recommend the upper end of the hosel be chamfered and filled with epoxy as the shaft is assembled to the head. This reduces the likelihood of shaft fracture at the top of the hosel, but nevertheless the problem still remains significant.

One aspect to achieving hosel weight reduction lies in the mistaken prevailing view of club head designers that the hosel bore must be deep to prevent shaft fracture and shaft loosening in the hosel. This view is simply false and has given misdirection to the desire to achieve weight saving in the hosel area.

Another misconception is that the hosel must extend a substantial distance above the top wall of the club head. This misconception may be a result, not only of a belief that the upwardly projecting hosel is necessary to support the shaft, but of the cosmetic need to have the hosel gently curve into the surface of the top wall of the club head 360 degrees around the hosel. That is, one reason club designers have not envisioned the elimination of the hosel upward projection from the top wall, is the cosmetic need for blending the lower end of the shaft into the top wall. However, these designers have not appreciated this result can be achieved without the hosel performing the entire cosmetic blending function.

It is, therefore, a primary object of the present invention to ameliorate the problems noted above in the prior art, and provide a golf club head with a shortened hosel and ferrule that reduces hosel weight without sacrificing shaft support or cosmetic integrity.

SUMMARY OF THE PRESENT INVENTION

In accordance with the present invention, an improved golf club head is provided with a shortened hosel that reduces overall hosel weight without sacrificing shaft support or without diminishing the smooth cosmetic transition of the shaft into the top wall of the club head.

The first direction to this objective is the awakening that extended hosel bore length is not critical to either shaft fracture resistance or to shaft loosening. The prevalent design criteria today is the hosel bore must be at least 1.25 inches in depth. This criterium is flawed. Our tests by some of the best long drivers in the United States (members of the LDA) indicate that hosel depth as short as about 0.500 inches is sufficient to maintain shaft integrity with thousands of swings at over 130 mph, far above the average golfer's swing speed which commonly range from 80 to 100 mph. This must be qualified with the use of a high strength and quality epoxy bonding agent.

The second recognition to achieving weight reduction in the hosel area was the discovery that substantial hosel projection above the top wall is not necessary for either shaft support or cosmetic transition from the shaft to the top wall, and that these functions could in part be provided by the ferrule rather than the hosel.

Toward these ends, one embodiment of the present invention has a hosel length of substantially less than 1.25 inches, and in the range of 0.625 to 0.750 inches. A second embodiment of the present golf club head has a shortened hosel and extended ferrule including a head having a hollow body with a ball striking wall, and a top wall extending rearwardly from the ball striking wall. The hosel extends downwardly from the top wall with a shaft receiving bore therein, and extends upwardly from the top surface of the club a much shorter distance than conventional with an almost flat top surface much larger than normal and an annular outer surface that flares sharply outwardly. The ferrule has a larger than normal lower surface equal in size and shape to the hosel top surface with an outer surface that curves sharply outwardly and downwardly in a smooth transition into the hosel outer surface and/or the top surface of the club head. The top of the hosel bore is chamfered, and the ferrule is epoxied not only to the inserted shaft but also to the enlarged hosel top surface to increase the hosel's ability to absorb side loading from the inserted shaft.

Since the ferrule is constructed of a light-weight thermoplastic material, albeit a high strength thermoplastic, according to the present invention, it is far lighter than even titanium alloys such as 6A4V titanium, an alloy frequently utilized in golf club head design, and a substantial weight savings results. In essence, the ferrule replaces in support and cosmetic functions the portion of the hosel projecting above the top wall of the club head. The cosmetic transition of the shaft into the top wall of the club head is predominantly provided, not by the hosel of past, but by the outward and downward flare of the ferrule itself.

If there is a trade-off in this design, it is that the ferrule shape may change with club head design, and hence in many cases must be customized for the club head design. This is because the bottom surface of the ferrule, according to the present invention, and the top surface of the hosel, have an irregular tear drop shape, unsuitable for annularly shaped ferrules presently available in the golf industry. However, this trade-off is attractive because ferrule tooling is quite inexpensive.

Ferrules available today, while not necessarily straight tubular in shape, and may have some outer curvature, nevertheless have circular cross sectional shapes in planes perpendicular to the hosel axis. Such ferrules will in some cases not be useable in the present invention, although it is possible to envision a downwardly and outwardly flared ferrule according to the present invention with a circular lower diameter, that could compliment a similarly shaped upper surface on the hosel and/or club head top wall.

In one embodiment described in this application, the upper surface of the hosel and lower surface of the ferrule are far larger than presently known. An important result of this design comes from the epoxy bonding of these two surfaces together, resulting in a far greater lateral support for the shaft than by conventional, and also provides an increased cushioning effect for the shaft that minimizes shaft fracture above the hosel. Present day ferrules provide little, if any, lateral support for the shaft; that is, the force applied to the ferrule against the shaft as the shaft bends outwardly of its axis in its relaxed position. This is because the area of the lower surface of the ferrule and the area of the upper surface of the hosel engaging the hosel lower surface in conventional club heads, is far smaller than in this embodiment of the present invention and the bonding there-between can fracture unnoticed because the ferrule remains bonded to the shaft.

Thus, another object of the present invention is to provide a ferrule design that effects the lateral support function of conventional hosels above the top wall of the club head with an enhanced cushioning effect from the elastic nature of the ferrule thermoplastic.

In a specific embodiment disclosed, the upper surface of the hosel and the lower surface of the ferrule have a tear drop outer shape with the point of the tear pointing toward a vertical plane extending along the target line. This is a fairly conventional shape for most metal woods in a sectional plane through the hosel just above the top wall upper surface, although it is a shape never identified before the present invention. That is, this plane is generally parallel to the top wall(less than 0.062 inches) above the top surface of the club head top wall. Because the top wall crowns near the target line, the transition surface of the hosel near that line causes this tear drop shape in that plane. It should be understood the present invention also contemplates a 100% elimination of the hosel upward projection and a bending of the ferrule directly into the top wall.

According to another embodiment of the invention, the lower surface of the ferrule has an annular flange that seats in a counter bore in the club head to further enhance the ferrule capability to resist side loading, caused by shaft flexure. This design also further protects the shaft from errant ball impact directly on the ferrule.

Other objects and advantages of the present invention will appear more clearly from the following detailed description.

DETAILED DESCRIPTION OF THE PREFERRED EMBODIMENTS

Figure 1:
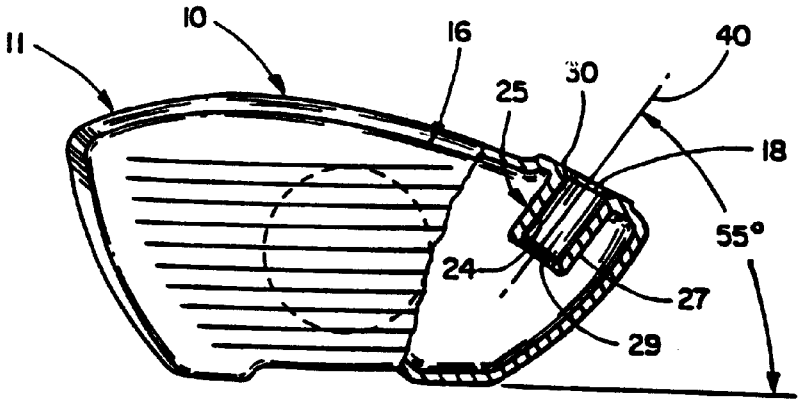
FIG. 1 is a front view, partly fragmented, of a golf club head according to the present invention without its ferrule in situ.
Figure 2:
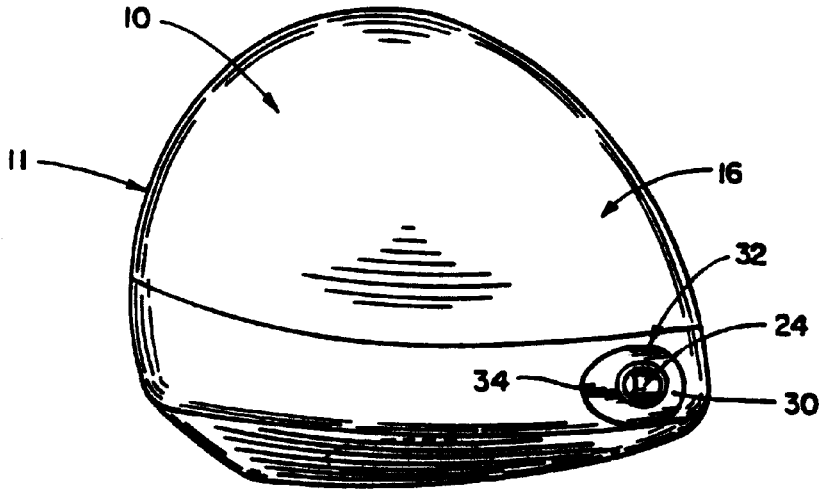
FIG. 2 is a top view of the club head illustrated in FIG. 1, also without its ferrule in situ.
Figure 3:
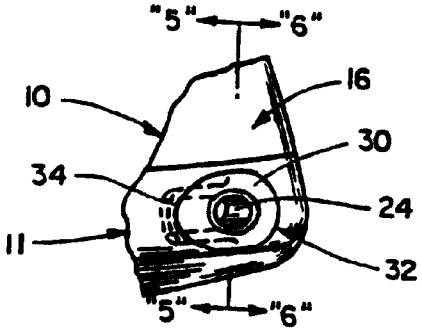
FIG. 3 is an enlarged fragmentary top view of the golf club head as depicted in FIG. 2.

Viewing the drawings, it should be understood that FIGS. 1 to 6 are drawn to scale; namely, 1 inch=1 inch, and it should be understood by the reader, however, that the patent application drawings, submitted with this application as originally filed, are drawn to 1=1 scale, and that the drawings, when printed into an issued patent, are usually reduced in size so that it should not be presumed that the drawings in the issued patent are also a 1:1 scale.

Referring to the drawings and particularly FIGS. 1 to 7, a club head assembly 10 is illustrated including generally a thin-walled hollow club head body 11, and a ferrule 12. The club head body has a face or ball striking wall 14, a top wall 16 from which a hosel segment 18 projects upwardly. The hosel segment 18 has an outer surface 20 that is complementary to the outer surface 22 of the ferrule 12 and the top wall 16.

The ferrule 12 has a shaft bore 23 therethrough approximately 0.334 inches in diameter coaxial with a same diameter bore 24 in the hosel 25 that includes the hosel segment 18.

The hosel 25 includes an annular portion 27 integrally cast with the club head body 11 and the top wall 16. Hosel portion 27 includes a bottom wall or abbreviated annular stop 29 that limits the downward insertion of the club shaft into the hosel bore 24.

An important aspect of the present invention is that the hosel segment 18 projects upwardly from the top surface 20 of the club head top wall 16 a distance of about 0.125 inches, preferably in the range of 0.00 inches to 0.130 inches.

Also, another important aspect of the present invention is the extent of the hosel bore 27 from the top surface 30 of the hosel segment 18 downwardly is about 0.600 inches, preferably in the range of 0.500 inches to 1.00 inches. This range with a slow curing high strength epoxy bonding agent is sufficient to bond the associated shaft to the hosel bore under the high stress conditions noted above even without the shortened hosel and extended ferrule.

Figure 4:
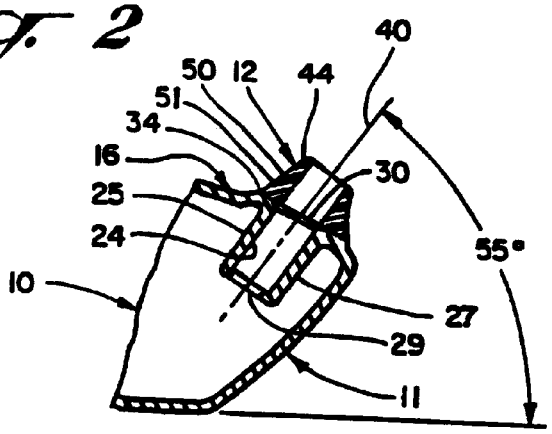
FIG. 4 is a fragmented section similar to FIG. 1 with the ferrule in situ and in section.
Figure 5:
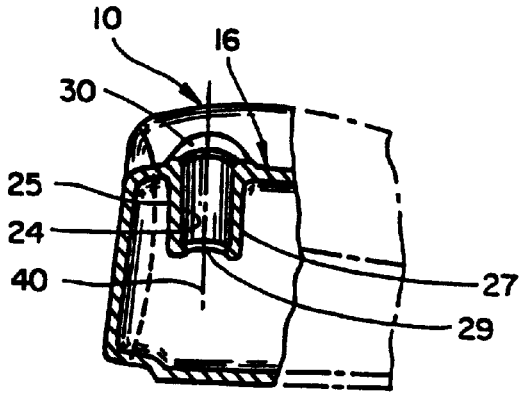
FIG. 5 is a fragmentary section of the golf club head along the hosel axis taken generally along line 5—5 of FIG. 3.
Figure 6:
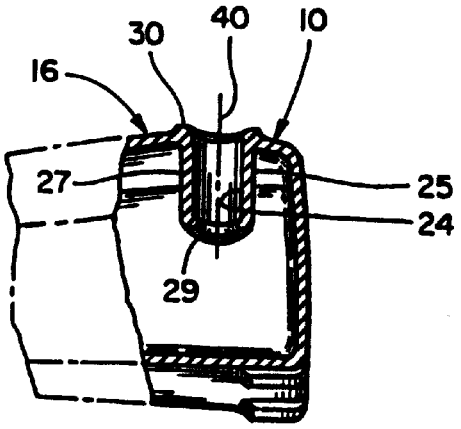
FIG. 6 is a fragmentary section taken through the hosel axis 180 degrees with respect to the plane of FIG. 5.
Figure 7:
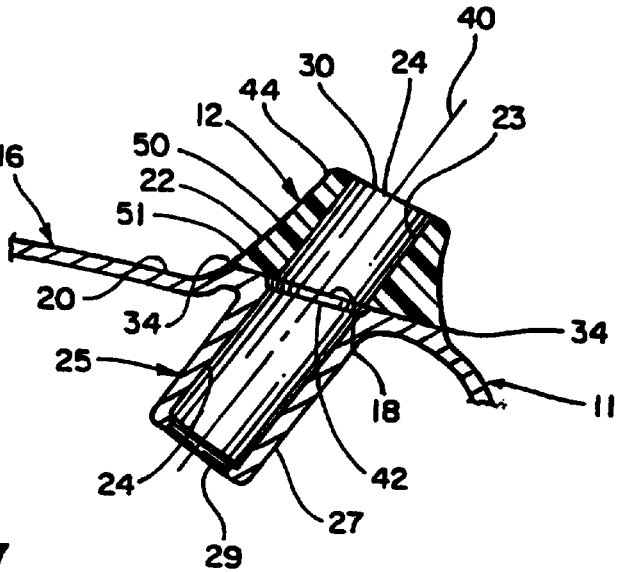
FIG. 7 is an enlarged fragmentary view similar to FIG. 4.
Figure 8:
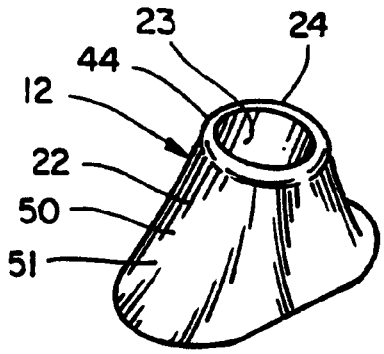
FIG. 8 is a perspective sub-assembly view of one embodiment of the ferrule according to the present invention.
Figure 9:
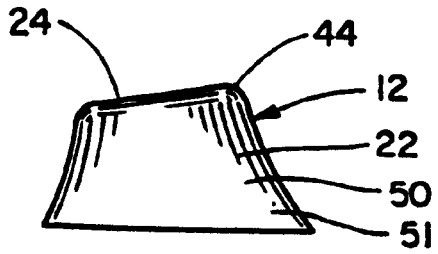
FIG. 9 is a rear view of the ferrule illustrated in FIG. 8.
Figure 10:
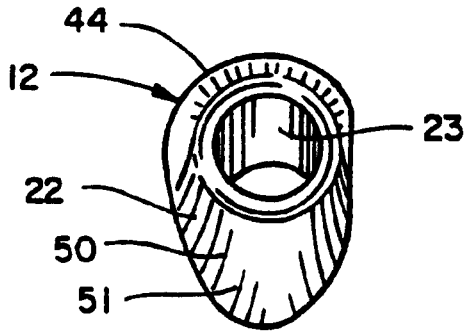
FIG. 10 is a bottom view of the ferrule illustrated in FIGS. 8 and 9.
Figure 11:
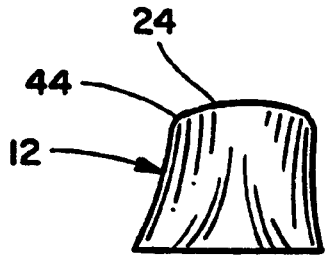
FIG. 11 is a left side view of the ferrule illustrated in FIGS. 8 to 10.
Figure 12:
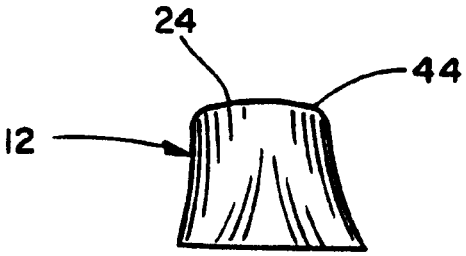
FIG. 12 is a right side view of the ferrule illustrated in FIGS. 8 to 11.
Figure 13:
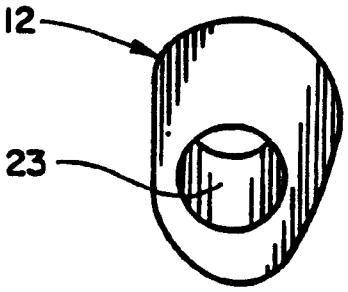
FIG. 13 is a bottom view of the ferrule illustrated in FIGS. 8 to 12.

The top surface 30 of the hosel segment 18 is considerably larger in area than conventional and is irregular in shape, taking a generally tear drop perimeter configuration. Top surface 30 includes a perimeter edge 32 with a pointed portion 34 that "points" perpendicularly toward a vertical plane on the target line extending through the face wall sweet spot. This pointed portion is defined in part by the outer surface 20 of the hosel segment 18. This outer surface 20 of the hosel segment 18 at pointed portion 34 in the plane of FIGS. 1 and 4 is angularly related at its upper reaches to the hosel-ferrule axis 40 by an angle of about 45 degrees and the surface 20 curves smoothly and tangentially into the top wall 16 at its lower reaches. Top surface 30 has an area of approximately 0.375 in.$^2$ inches including the area of bore 24.

The tear drop shape of the top surface of the hosel segment 18 is a result of the top wall 16 of the club head crowning above the hosel along a vertical plane extending along the target line through the ball striking point on the face wall. This results in the curvature of the hosel outer wall 20 having a larger radius at portion 34. Top wall 30 has an angle of about 20 degrees to a horizontal plane and angularly related to a plane perpendicular to hosel axis 40 by about 10 degrees.

It should be noted here what the approximate geometry of the club head and hosel is. The "lie" of the club head is the angle of the hosel axis to ground in a vertical plane perpendicular to the target line and is conventionally about 55 degrees in the driver. The plane of the top surface 30 of the hosel segment 18 and the bottom surface 42 of the ferrule 12 is about 100 degrees clockwise from the axis 40 of the hosel-ferrule.

An important aspect of the present invention is that the top surface 30 of the hosel segment and the bottom surface 42 of the ferrule have a mating area of about 7 times presently known hosel-ferrule mating surfaces. These surfaces are bonded with a two part slow setting, high strength epoxy material, and because of the increased bonding area, produces a higher strength ferrule bond and ferrule that resists lateral or bending forces of the shaft above the hosel to a greater extent than conventional hosels. The present ferrule is constructed of a high strength thermoplastic material and it in effect cushions the lateral forces imposed by the shaft on the ferrule minimizing shaft fracture at the hosel. This enhanced hosel support for the shaft immediately above the hosel and minimizes shaft fracture in the hosel area.

The configuration of the ferrule 12 is generally short in axial extent and replaces in part in that area the desired functions normally attributed to the hosel, and particularly the support function of the hosel and the blending function of the hosel as it merges into the club head top wall.

Generally, this is achieved by configuring the outer surface of the ferrule at its lower extent with an outward flare that varies in the degree of flare as one moves 360 degrees about the lower outer surface of the ferrule to achieve a complementary configuration to the outer surface of the reduced height hosel. The ferrule has an upper annular portion 44 having an outer diameter approximating conventional ferrules. From that upper portion, however, the outer surface 22 of the ferrule has a first transition portion 50 in the direction of portion 44 in the plane of FIG. 7, of about 30 degrees with respect to the hosel axis. Surface 22 has a second lower transition portion 51 also in the same plane, of about 45 degrees with respect to the hosel axis 40.

The transition portions 50 and 51 are at the hosel point portion 34. The other transition curvature portions on surface 22 as one moves around the perimeter of the lower portion of the ferrule as it blends into the hosel surface 20, have different curvatures than portions 50 and 51 to achieve the blending into the top wall depending on specific club head designs. It should also be understood that head and hosel shape may vary from club to club and that transition portions 50 and 51 may have somewhat more or less curvature than noted above.

Figure 14:
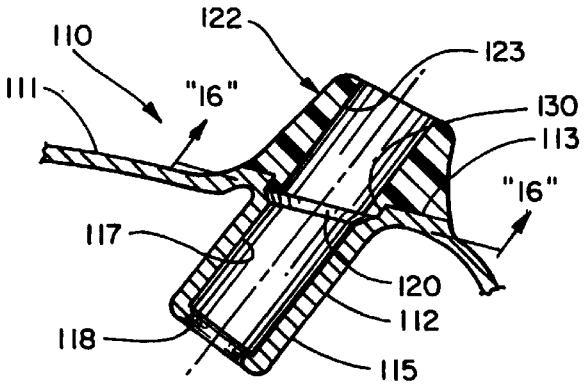
FIG. 14 is a fragmentary section of another embodiment of the present invention.
Figure 15:
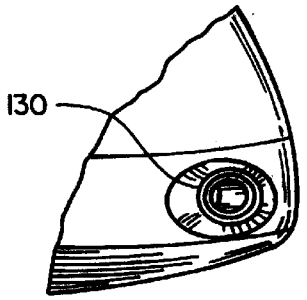
FIG. 15 is a fragmented top view of the club head illustrated in FIG. 14.
Figure 16:
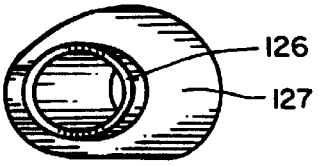
FIG. 16 is a bottom view of the ferrule illustrated in FIG. 14 taken generally along line 16—16 of FIG. 14.

FIGS. 14, 15 and 16 depict a further embodiment of the present invention including a metallic club head 110 having a top wall 111 and a hosel 112. The hosel 112 has an upper surface 113 that projects about 0.625 inches above the upper surface of the club head top wall 111. Hosel 112 also has a downwardly depending portion 115 that extends within the club head cavity having a shaft receiving bore 117 therein with a lower integral annular flange 118 that serves as a stop for the golf shaft, which is not illustrated in the drawings.

The upper end of the hosel bore 117 has a 45 degree chamfer 120 that receives epoxy when the shaft is epoxied in the club head to provide a known cushioning effect for the shaft, particularly when the shaft is a graphite composition.

It should be understood that many of the principles of the present invention can be applied not only to a hosel that projects only a short distance above the top wall 111, and this is true of all the embodiments disclosed in this application, but to hosels which have no projection from the top wall 11 and are flush with the top wall.

A ferrule 122, similar to the ferrules illustrated in the embodiments of FIGS. 1 to 13, is seated on hosel top surface 113, and it has a shaft receiving bore 123 therein coaxial with bore 117. The differentiating aspect in the embodiment of FIGS. 14, 15 and 16 is an annular flange 126 that depends downwardly from ferrule lower planar surface 127 coaxial with the bores 123 and 117 that fits within a counter bore 130 in the upper end of the hosel bore 117, immediately above the chamfer 120. The axial extent of counter bore 130 and the flange 126 is in the range of 0.625 to 0.125 inches.

The flange 126 and the counter bore 130 provide enhanced resistance to side loading and torquing of the ferrule caused by shaft flexure. An ancillary benefit to the flange and counter bore system in this embodiment is that it provides further protection for the shaft when the ferrule is impacted directly by the golf ball due to an extremely errant "heel" golf swing.

Figure 17:
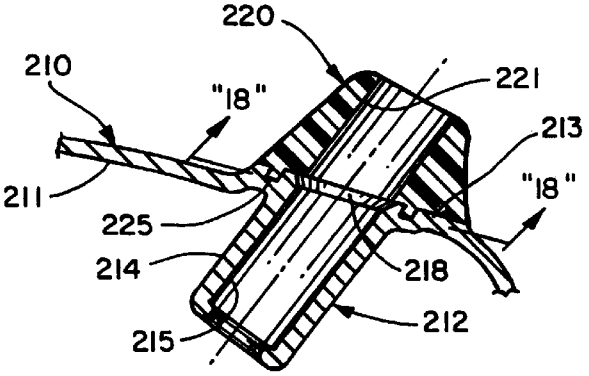
FIG. 17 is a fragmentary view of a further embodiment of the present invention.
Figure 18:
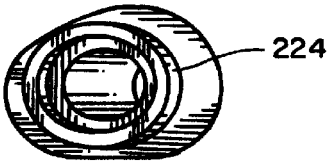
FIG. 18 is a bottom view of the ferrule illustrated in FIG. 17 taken generally along line 18—18 of FIG. 17.
Figure 19:
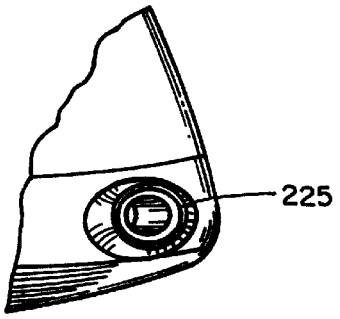
FIG. 19 is a fragmented top view of the club head illustrated in FIGS. 17.

The further embodiment illustrated in FIGS. 17, 18 and 19 is similar to the embodiment illustrated in FIGS. 14, 15 and 16, except that the ferrule flange has a larger diameter and is seated in a groove spaced outwardly from the hosel bore. This design has some additional benefits in cases where the bottom of the ferrule is substantially wider than a conventional hosel.

Toward these ends, a club head 210 is illustrated having a top wall 211 and an integral hosel 212 having an upper surface 213 that is substantially coplanar with top wall 211 or projects slightly upwardly therefrom. Hosel 212 has a downwardly projecting annular portion 214 with a hosel bore 215 therein that has an annular chamfer 218 at its upper end that is coplanar with the top surface 213 as opposed to being spaced downwardly therefrom as in the FIGS. 14, 15 and 16 embodiment.

A plastic ferrule 220 is mounted on the top surface 213, and it has a through bore 221 therein coaxial with hosel bore 215.

The ferrule 220 has an integral annular flange 224 projecting downwardly therefrom as seen in FIG. 18, having an inner diameter substantially larger than bore 221 that is seated in an annular groove 225 in hosel top surface 213. The annular groove 225 could also be formed directly in top wall 211 if the geometry of the club head permitted this relationship.

The larger diameter of the flange 224 in this embodiment can in some cases provide greater resistance to torquing loads on the ferrule than the flange geometry in the FIGS. 14, 15 and 16 embodiment.

It should be understood that in both the embodiments illustrated in FIGS. 14, 15 and 16, and the embodiment illustrated in FIGS. 17, 18 and 19, that the lower surfaces of the ferrule, the ferrule flanges, and the grooves receiving the ferrule flanges all are epoxied as the ferrule is assembled and bonded to the club head.

Figure 20:
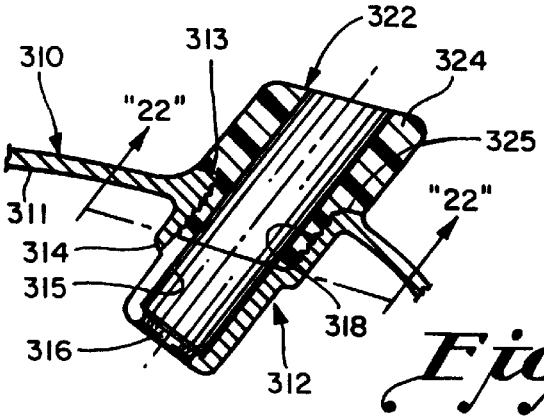
FIG. 20 is a fragmentary section of a further embodiment of the present invention having a threaded ferrule.
Figure 21:
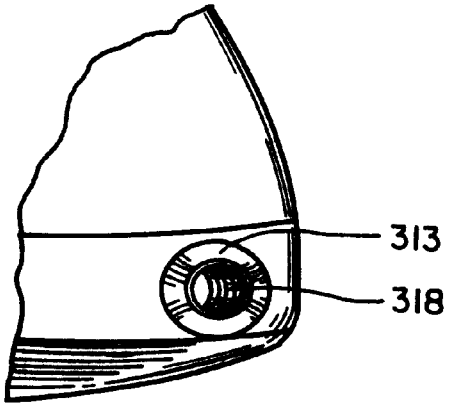
FIG. 21 is a fragmented top view of the club head illustrated in FIG. 20.
Figure 22:
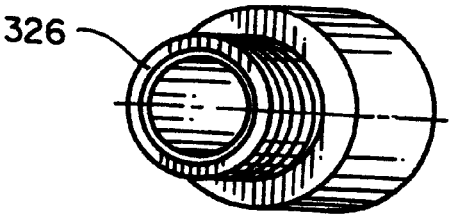
FIG. 22 is a bottom view of the ferrule illustrated in FIG. 20 taken generally along line 22—22 of FIG. 20.

A further embodiment of the present invention is illustrated in FIGS. 20, 21, and 22 and in this embodiment the ferrule has a threaded flange that is received in a threaded counter bore in the hosel, and this design provides somewhat greater resistance to torquing loads than in the embodiments illustrated in FIGS. 1 to 19, and also a somewhat greater cushioning effect for the shaft, but the trade-off in this design is the ferrule shape is substantially confined to an annular configuration in the sense that it cannot accommodate the cosmetic flares of the club head top wall that surround the hosel described in connection with the above embodiments.

Toward these ends, a club head 310 is illustrated having a top wall 311 and an integral hosel 312. The hosel 312 has a planar upper surface 313 that projects a short distance above the top wall 211. Hosel 212 has a stepped downward projection 314 having a shaft receiving bore 315 therein with a lower stop 316 as in the other embodiments.

The upper end of the hosel bore has an extended counter bore 318 that is threaded, as also seen in FIG. 21. The counter bore 318 is substantially longer axially than in the other embodiments and is in the range of 0.250 inches and above. An annular ferrule 322 is threaded in counter bore 318 and has an annular upper portion 324, a flat lower surface 325 seated on club head surface 313, and an integral annular threaded downwardly depending flange 326 threadedly received in counter bore 318. The inner engaging threaded surfaces between ferrule 322 and the hosel 312 receive epoxy during assembly as do the surfaces 313 and 325.

I claim:

1. A golf club head, comprising: a golf club head including a ball striking face and a top wall, means to reduce club head weight and permit the saved weight to be redistributed in the club head including a light weight hosel in the club head having a top surface that is coplanar with or projects upwardly a short distance from the top wall, and a ferrule constructed of a material substantially lighter than the club head mounted against the top surface of the hosel, said ferrule having a downwardly depending flange seated in a groove in the club head to resist side loading on the ferrule, said ferrule having an upper small diameter portion and a lower large diameter portion to blend into the upper surface of the top wall adjacent the hosel, said ferrule having an outer surface that curves outwardly from the upper portion to the lower portion sufficiently so its lower end is tangent to the upper surface of the top wall adjacent the hosel.

2. A golf club head as defined in claim 1, wherein the club head groove is an annular groove in the club head, said ferrule flange being annular and seated within the annular groove in the club head.

3. A golf club head as defined in claim 2, wherein the hosel has a shaft receiving bore therein, said groove in the club head being a counter bore in the hosel bore.

4. A golf club head as defined in claim 2, wherein the hosel has a shaft receiving bore therein, said annular groove being spaced radially outwardly from the hosel bore in the club head top wall.

5. A golf club head as defined in claim 2, wherein said annular groove in the club head is threaded and engages threads in the ferrule annular flange.

6. A golf club head, comprising: a metallic golf club head including a ball striking face and a top wall, means to reduce club head weight and permit the saved weight to be redistributed in the club head including a light weight hosel integral with the club head with a top surface coplanar with or projecting upwardly from the top wall less than 0.200 inches, said hosel having a shaft receiving bore therein, an annular groove in the club head coaxial with the hosel bore, and a lightweight non-metallic ferrule seated on the hosel top surface, said ferrule having an integral downwardly depending annular flange seated in the annular groove in the club head to resist side loading on the ferrule, said ferrule having an upper small diameter portion and a lower large diameter portion to blend into the upper surface of the top wall adjacent the hosel, said ferrule having an outer surface that curves outwardly from the upper portion to the lower portion sufficiently so its lower end is tangent to the upper surface of the top wall adjacent the hosel.

7. A golf club head, comprising: a metallic golf club head including a ball striking face and a top wall, means to reduce club head weight and permit the saved weight to be redistributed in the club head including a light weight hosel integral with the club head with a top surface coplanar with or projecting upwardly from the top wall less than 0.200 inches, said hosel having a shaft receiving bore therein, a threaded counter bore in the top of the hosel bore, and a lightweight non-metallic ferrule seated on the hosel top surface having an integral threaded downwardly depending annular flange threadedly seated in the hosel counter bore to resist side loading on the ferrule, said ferrule having an upper small diameter portion and a lower large diameter portion to blend into the upper surface of the ton wall adjacent the hosel, said ferrule having an outer surface that curves outwardly from the upper portion to the lower portion sufficiently so its lower end is tangent to the upper surface of the top wall adjacent the hosel.

* * * * *